US010824115B2

(12) United States Patent
Kawata

(10) Patent No.: US 10,824,115 B2
(45) Date of Patent: Nov. 3, 2020

(54) TIMEPIECE

(71) Applicant: Seiko Instruments Inc., Chiba (JP)

(72) Inventor: Masayuki Kawata, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 72 days.

(21) Appl. No.: 15/885,022

(22) Filed: Jan. 31, 2018

(65) Prior Publication Data

US 2018/0224805 A1 Aug. 9, 2018

(30) Foreign Application Priority Data

Feb. 6, 2017 (JP) ..... 2017-019236
Nov. 7, 2017 (JP) ..... 2017-214521

(51) Int. Cl.

| | |
|---|---|
| ***G04C 3/00*** | (2006.01) |
| ***G04G 17/04*** | (2006.01) |
| ***G04C 10/02*** | (2006.01) |
| ***G04B 19/04*** | (2006.01) |
| ***G04B 19/14*** | (2006.01) |
| ***G04B 29/00*** | (2006.01) |

(52) U.S. Cl.

CPC ..... *G04C 3/008* (2013.01); *G04B 19/044* (2013.01); *G04B 19/14* (2013.01); *G04C 10/02* (2013.01); *G04G 17/045* (2013.01); *G04B 29/00* (2013.01)

(58) Field of Classification Search

CPC ..... G04B 19/044; G04B 19/14; G04C 3/008; G04C 10/02; G04G 17/045; G04R 60/10

See application file for complete search history.

(56) References Cited

FOREIGN PATENT DOCUMENTS

| | | | |
|---|---|---|---|
| JP | UM 2-131690 | A | 5/1990 |
| JP | 11-148981 | A | 6/1999 |
| JP | 2004-286467 | A | 10/2004 |
| JP | 2011-163874 | A | 8/2011 |
| JP | 2012-108043 | A | 6/2012 |
| JP | 2017-181081 | A | 10/2017 |

OTHER PUBLICATIONS

Notification of Reasons for Refusal/Office Action for Japan Application No. 2017-214521 dated Dec. 1, 2018, pp. 1-7.

*Primary Examiner* — Edwin A. Leon
*Assistant Examiner* — Jason M Collins
(74) *Attorney, Agent, or Firm* — Brinks Gilson & Lione

(57) ABSTRACT

A timepiece allowing accurate positioning of a display plate and a plate member is to be provided. A timepiece 10 includes: a main plate 2 having one or more positioning portions 21 and 22; a plate member 3 having one or more first positioning receiving portions 33 to be locked to the positioning portions 21 and arranged so as to overlap the main plate 2; and a display plate 5 having one or more second positioning receiving portions 55 to be locked to the positioning portions 22 and arranged so as to overlap the plate member 3.

12 Claims, 8 Drawing Sheets

TIMEPIECE

RELATED APPLICATIONS

This application claims priority under 35 U.S.C. § 119 to Japanese Patent Application Nos. 2017-019236 filed on Feb. 6, 2017 and 2017-214521 filed on Nov. 7, 2017, the entire content of which are hereby incorporated by reference.

BACKGROUND OF THE INVENTION

1. Field of the Invention

The present invention relates to a timepiece.

2. Description of Related Art

For example, in an analog timepiece indicating time on a dial by using an indicator hand, a plate-lie solar cell is sometimes used (See, for example, Patent Document 1 (JP-A-11-148981)).

The timepiece disclosed in Patent Document 1 is equipped with a module, a solar cell (plate member), a support member, and a display plate. The solar cell is set in position with respect to the module through engagement between a positioning recess and a positioning protrusion of the module. The display plate is set in position with respect to the support member through engagement between a positioning protrusion and a positioning recess of the support member. The support member is fixed to the module through engagement between a locking hook and a locking recess of the module.

The above-mentioned timepiece is subject to positional deviation of the display plate and the solar cell in the in-plane direction. Further, variation is likely to be generated in the position in the thickness direction of the display plate, so that it is necessary to secure a sufficient gap between the indicator hand and the display plate taking the variation into consideration. Thus, the timepiece is disadvantageous in terms of a reduction in thickness.

SUMMARY OF THE INVENTION

It is an object of a mode of the present invention to provide a timepiece allowing precise positioning of a display plate and a plate member.

According to a mode of the present invention, there is provided a timepiece including: a main plate having one or more positioning portions; a plate member having one or more first positioning receiving portions to be locked to the positioning portions and arranged so as to overlap the main plate; and a display plate having one or more second positioning receiving portions to be locked to the positioning portions and arranged so as to overlap the plate member.

In this construction, both the plate member and the display plate are set in position with respect to the main plate, so that it is possible to set the plate member and the display plate precisely in the in-plane direction.

Further, the display plate is set in position while directly in contact with the main plate, so that it is possible to set the display plate precisely in position in the thickness direction. Thus, for example, a design is possible in which the gap between the indicator hand and the display plate is small, which is advantageous from the viewpoint of a reduction the thickness of the timepiece.

The positioning may be protrusions formed on the main plate, and the first positioning receiving portions and the second positioning receiving portions may be recesses locked to the positioning portions.

In this construction, as compared with the case where protrusions are formed on the plate member and the display plate and where recesses to be locked to the protrusions are formed in the main plate, the structure of the plate member and the display plate is simplified, and the production thereof is facilitated.

The timepiece may be further equipped with a frame body pressing the plate member against the main plate.

In this construction, it is possible to prevent rising of the plate member, and to set the plate member in position precisely in the thickness direction. Further, by forming the frame body in a configuration surrounding the outer periphery of the display plate, it is possible to prevent the display plate from being inadvertently detached at the time of accommodation in a case or the like. Further, it is possible to press the plate member against a terminal of the main plate, so that it is possible to provide a reliable electrical conduction between the plate member and the terminal.

The timepiece may have on the main plate a base portion abutting the display plate and determining the position in the thickness direction of the display plate.

In this construction, it is possible to enhance the positioning accuracy in the thickness direction of the display plate.

The timepiece may have on the main plate a display plate fixing portion fixing the display plate, and the display plate may have a fixation receiving portion to be engaged with the display plate fixing portion.

In this construction, it is possible to fix the display plate reliably to the main plate.

In the timepiece, the plate member may be a solar battery.

In this construction, it is possible to convert light from the sun, illumination, etc. to electrical energy and to utilize it.

In the timepiece, at least one of the first positioning receiving portions and at least one of the second positioning receiving portions are locked to the positioning portion common to them.

In this construction, it is possible to enhance the positioning accuracy of the plate member and the display plate as compared with the case where the positioning portions to which the plate member and the display plate are locked are different from each other.

In the timepiece, an anti-magnetic plate may be provided on the main plate side of the plate member, and the anti-magnetic plate may have one or more third positioning receiving portions to be locked to the positioning portions.

In this construction, due to the anti-magnetic plate, it is possible to suppress the influence of an external magnetic field on a motor or the like.

The timepiece may be further equipped with an antenna element, and may have a cutout avoiding a position overlapping the antenna element as seen from the thickness direction of the main plate.

In this construction, it is possible to prevent the antenna element from being covered with the anti-magnetic plate, making it possible to enhance the transmission/reception characteristics of the antenna element.

In the timepiece, the anti-magnetic plate may be electrically continuous with a ground conduction portion provided on the main plate side In this construction, it is possible to suppress electrostatic noise.

In the timepiece, a display plate fixation portion fixing the display plate may be formed on the main plate, and the anti-magnetic plate may have a guide receiving portion to be locked to the display plate fixation portion.

In this construction, even when deformation is generated in the third positioning receiving portion as a result of the application of a shock due to dropping or the like, it is possible to prevent detachment of the anti-magnetic plate through the locking of the display plate fixation portion to the guide receiving portion.

According to a mode of the present invention, there are provided: a main plate having one or more positioning portions; a plate member having one or more first positioning receiving portions to be locked to the positioning portions and arranged so as to overlap the main plate; and a display plate having one or more second positioning receiving portions to be locked to the positioning portions and arranged so as to overlap the plate member.

According to a mode of the present invention, both the plate member and the display plate are set in position with respect to the main plate, so that it is possible to set the plate member and the display plate in position with precision in the in-plane direction. Further, the display plate is set in position while directly in contact with the main plate, so that it is possible to set the display plate in position with precision also in the thickness direction.

BRIEF DESCRIPTION OF THE DRAWINGS

FIG. 13 is a perspective view illustrating how an anti-magnetic plate is mounted.

DETAILED DESCRIPTION OF THE EMBODIMENT

Embodiments of the present invention will be described with reference to the drawings. In the embodiments described below, the present invention is applied to an electronic timepiece.

First Embodiment

Figure 1:
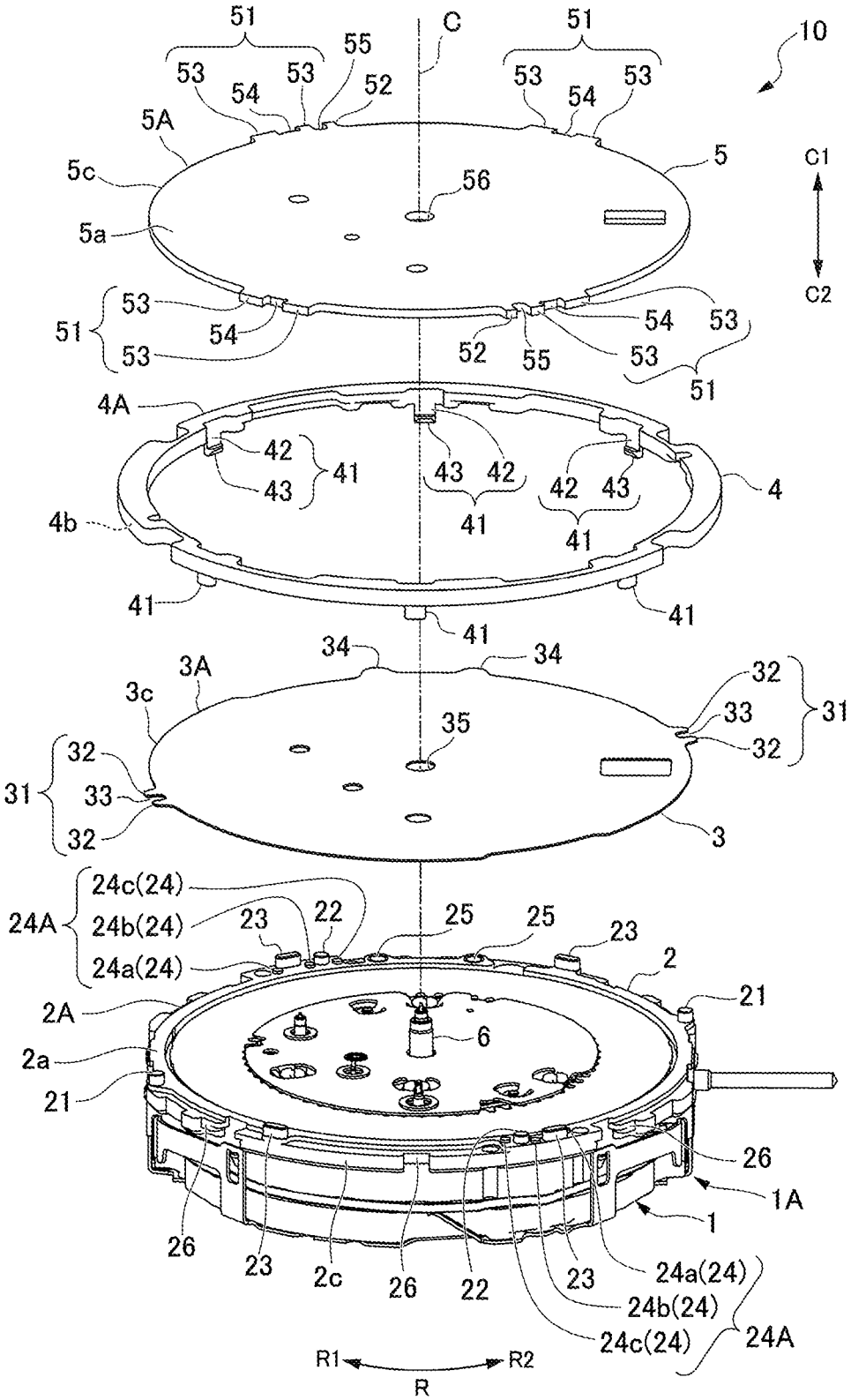
FIG. 1 is an exploded perspective view of a timepiece according to a first embodiment.

FIG. 1 is an exploded perspective view of an electronic timepiece 10 (timepiece) according to the first embodiment.

As shown in FIG. 1, the electronic timepiece 10 is equipped with a movement 1 and a display plate 5. The movement 1 is equipped with a movement main body 1A, a main plate 2, a solar battery 3, a frame body 4, and an indicator hand shaft 6. The display plate 5 is situated on the upper side of the movement 1. Symbol C indicates the center axis of the electronic timepiece 10. Of the directions along the center axis C, one direction will be referred to as a first axial direction C1, and the direction opposite the first axial direction C1 will be referred to as a second axial direction C2. In the following, the first axial direction C1 is sometimes referred to as the upper side, and the second axial direction C2 as the lower side. The center axis C1 extends through the centers of the movement 1 (the main plate 2, the solar battery 3, the frame body 4, and the indicator shaft 6) and the display plate 5.

The direction around the center axis C will be referred to as a peripheral direction R. Of the peripheral direction R, one direction will be referred to as a first peripheral direction R1, and the direction opposite the first peripheral direction will be referred to as a second peripheral direction R2. The direction along a plane perpendicular to the center axis C will be referred to as the in-plane direction.

The electronic timepiece 10 has indicator hands (the hour hand, the minute hand, and the second hand) (not shown) mounted to the indicator hand shaft 6. Although not shown, the electronic timepiece 10 may be equipped with a windshield, a case back, a bezel, a case, and a belt. The case accommodates the movement 1 and the display plate 5. The windshield is mounted to the opening of the case by means of the bezel. The windshield is formed of a material allowing transmission of light like sunlight such as glass or plastic.

The movement 1 (more specifically, the movement main body 1A) is equipped, for example, with a circuit block (for example, an oscillation circuit and a control circuit), a battery (secondary battery), and a motor. The battery is charged with electrical energy supplied by the solar battery 3. The motor drives the indicator hand shaft 6.

The main plate 2 has a plate-like main body portion 2A, a pair of first positioning protrusions 21 (positioning portions, protrusions), a pair of second positioning protrusions 22 (positioning portions, protrusions), a plurality of fixation protrusions 23 (displacement plate fixation portions), a pair of height base portion groups 24A, and a pair of solar battery terminals 25. The main plate 2 is provided on the upper surface side of the movement main body 1A. The main body portion 2A is formed substantially in an annular configuration as seen, for example, from a direction parallel to the center axis C.

The first positioning protrusions 21 are formed on a first main surface 2*a* (the surface on the first axial direction C1 side) of the main body portion 2A so as to protrude in the first axial direction C1 (upwards in FIG. 1). There are no particular restrictions regarding the configuration of the first positioning protrusions 21. For example, they are of a columnar configuration having a center axis parallel to the center axis C. The pair of first positioning protrusions 21 are situated at positions spaced away from each other in the peripheral direction R. While there are no particular restrictions regarding the relative positions of the first positioning protrusions 21, it is desirable for them to be, for example, at positions of rotational symmetry with respect to the center axis C.

The number of the first positioning protrusions is not restricted to 2. It may be 1 or an arbitrary number (plural number) of 2 or more. The plurality of first positioning protrusions can be formed at rotationally symmetrical positions of n-times symmetry (n is an integer of 2 or more) with respect to the center axis C.

The second positioning protrusions 22 are formed on the first main surface 2*a* of the main body portion 2A so as to protrude in the first axial direction C1 (upwards in FIG. 1). There are no particular restrictions regarding the configuration of the second positioning protrusions 22. For example, they are of a columnar configuration having a center axis parallel to the center axis C. The pair of second positioning protrusions 22 are situated at positions spaced away from each other in the peripheral direction R. There are no particular restrictions regarding the relative positions of the pair of second positioning protrusions 22. For example, it is desirable for them to be rotationally symmetrical with respect to the center axis C.

The positions in the peripheral direction R of the second positioning protrusions 22 are different from those of the first positioning protrusions 21. In the electronic timepiece 10 shown in FIG. 1, the second positioning protrusions 22 are at positions deviated from the first positioning protrusions 21 in the peripheral direction R by approximately 90°.

The number of the second positioning protrusions is not restricted to 2. It may be 1 or an arbitrary number (plural number) of 2 or more. The plurality of second positioning protrusions can be formed at rotationally symmetrical positions of n-times symmetry (n is an integer of 2 or more) with respect to the center axis C.

The fixation protrusions 23 are formed on the first main surface 2*a* of the main body portion 2A so as to protrude in the first axial direction C1 (upwards in FIG. 1). There are no particular restrictions regarding the configuration of the fixation protrusions 23. For example, they are of a columnar configuration which is elliptical as seen in a direction parallel to the center axis C (elliptical columnar configuration). For example, the fixation protrusions 23 are of an elliptical columnar configuration the major axis direction of which is perpendicular to the radial direction of the main body portion 2A.

The plurality of (e.g., 4 in the electronic timepiece 10 of FIG. 1) fixation protrusions 23 are formed at intervals in the peripheral direction R. In the electronic timepiece 10 shown in FIG. 1, the positions in the peripheral direction R of a part of the plurality of fixation protrusions 23 (two fixation protrusions 23 in FIG. 1) are positions in close proximity to the second positioning protrusions 22.

The number of fixation protrusions is not restricted to 4. It may be 1 or an arbitrary number (plural number) of 2 or more.

Each of the pair of height base portion groups 24A has a plurality of height base portions 24. The height base portions 24 are formed on the first main surface 2*a* of the main body portion 2A so as to protrude in the first axial direction C1 (upwards in FIG. 1). There are no particular restrictions regarding the configuration of the height base portions 24. For example, they are of a columnar configuration having a center axis parallel to the center axis C.

In the electronic timepiece 10 shown in FIG. 1, each height base portion group 24A includes three height base portions 24 at different positions in the peripheral direction R. These three height base portions 24 will be referred to as first through third height base portions 24*a* through 24*c*. The first height base portion 24*a* and the second height base portion 24*b* are at positions in close proximity to the fixation protrusion 23. The second height base portion 24*b* and the third height base portion 24*c* are at positions in close proximity to the second positioning protrusion 22. The position in the peripheral direction R of the first height base portion 24*a* is a position to the second peripheral direction R1 as compared with the fixation protrusion 23. The position in the peripheral direction R of the second height base portion 24*b* is a position to the first peripheral direction R1 as compared with the fixation protrusion 23, and to the second peripheral direction R2 as compared with the second positioning protrusion 22. The position in the peripheral direction R of the third height base portion 24*c* is a position to the first peripheral direction R1 as compared with the second positioning protrusion 22.

The pair of height base portion groups 24A are at positions spaced away from each other in the peripheral direction R. There are no particular restrictions regarding the relative positions of the pair of height base portion groups 24A. For example, it is desirable for them to be at rotationally symmetrical with respect to the center axis C.

The number of height base portion groups is not restricted to 2. It may be 1 or an arbitrary number (plural number) of 2 or more. The plurality of height base portion groups can be formed at rotationally symmetrical positions of n-times symmetry (n is an integer of 2 or more) with respect to the center axis C.

Solar battery terminals 25 are terminals effecting electrical conduction between the circuit block of the movement 1 (including, for example, an oscillation circuit and a control circuit) and the solar battery 3. A pair of solar battery terminals 25 are provided on the first main surface 2*a* of the main body portion 2A at intervals in the peripheral direction R.

In the outer peripheral surface 2*c* of the main body portion 2A, there are formed a plurality of engagement recesses 26. The engagement recesses 26 are formed over the entire thickness of the main body portion 2A. A plurality of (for example, six, in the electronic timepiece 10 of FIG. 1) engagement recesses 26 are formed at intervals (preferably at equal intervals) in the peripheral direction R.

The number of engagement recesses is not restricted to 6. It may be 1 or an arbitrary number (plural number) of 2 or more. The plurality of engagement recesses can be formed at rotationally symmetrical positions of n-times symmetry (n is an integer of 2 or more) with respect to the center axis C.

The solar battery 3 operates a generating portion converting light from the sun, illumination or the like to electrical energy. The solar battery 3 is a plate member formed in a plate-like configuration. The solar battery 3 is arranged so as to overlap the main plate 2.

The solar battery 3 has a main body portion 3A, a pair of first protrusion groups 31, and a pair of conduction protrusions 34.

The main body portion 3A is formed substantially in a circular configuration as seen from a direction parallel to the center axis C. At the center of the main body portion 3A, there is formed an insertion hole 35 through which the indicator hand shaft 6 is passed.

Each of the pair of first protrusion groups 31 has two displacement regulating protrusions 32. The displacement regulating protrusions 32 are formed at an outer peripheral edge 3*c* of the main body portion 3A so as to protrude outwards in the radial direction of the main body portion 3A. The two displacement regulating protrusions 32 are in close proximity to each other, and are formed at an interval in the peripheral direction R.

The recessed portion formed between the two displacement regulating protrusions 32 will be referred to as a first positioning recess 33 (first positioning receiving portion). The first positioning recess 33 is formed at a position allowing locking of the first positioning protrusion 21 of the main plate 2. The dimension in the peripheral direction R of the first positioning recess 33 is designed so as to make it possible to regulate positional deviation of the solar battery 3 when the first positioning protrusion 21 of the main plate 2 enters the first positioning recess 33 and is locked thereto.

The pair of first protrusion groups 31 are at positions spaced away from each other in the peripheral direction R. There are no particular restrictions regarding the relative positions of the pair of first protrusion groups 31. For example, it is desirable for them to be rotationally symmetrical positions with respect to the center axis C.

The number of first protrusion groups is not restricted to 2. It may be 1 or an arbitrary number (plural number) of 2 or more. The plurality of first protrusion groups can be formed at rotationally symmetrical positions of n-times symmetry (n is an integer of 2 or more) with respect to the center axis C.

The conduction protrusions 34 are formed at the outer peripheral edge 3*c* of the main body portion 3A so as to protrude outwards in the radial direction of the main body portion 3A. The pair of conduction protrusions 34 are formed at an interval in the peripheral direction R. The conduction protrusions 34 abut the solar battery terminals 25 of the main plate 2 to provide electrical conduction.

The frame body 4 is equipped with a main body portion 4A and a plurality of frame body fixation portions 41. The frame body 4 is provided on the solar battery 3.

The main body portion 4A is formed in a substantially circular configuration as seen, for example, from the direction parallel to the center axis C. The main body portion 4A is, for example, of a configuration surrounding the outer periphery of the display plate 5. The main body portion 4A can abut the upper surface (the surface on the first axial direction C1 side) of a part of the solar battery 3 (for example, the first protrusion groups 31 and the conduction protrusions 34).

Each frame body fixation portion 41 has a main portion 42 and a fixation claw 43. The main portion 42 is formed on a second main surface 4*b* (the surface on the second axial direction C2 side) so as to protrude in the second axial direction C2 (downwards in FIG. 1). The main portion 42 is, for example, of a plate-like configuration perpendicular to the radial direction of the main body portion 4A. The main portion 42 allows elastic bending deformation in the thickness direction. The width of the main portion 42 (the dimension in the peripheral direction R) is determined so as to allow it to enter the engagement recess 26 of the main plate 2.

The fixation claw 43 protrudes from the lower end portion of the main portion 42 so as to protrude inwards in the radial direction of the frame body 4.

Each frame body fixation portion 41 is formed so as to be engaged with the engagement recess 26 of the main plate 2. The frame body fixation portions 41 are provided in the same number (six) as the engagement recesses 26, and are formed at intervals (preferably at equal intervals) in the peripheral direction R. The main portions 42 enter the engagement recesses 26 of the main plate 2, and the fixation claws 43 are locked to the main plate 2 at the lower ends of the engagement recesses 26, whereby the frame body fixation portions 41 regulate upward movement (in the first axial direction C1) of the frame body 4.

The frame body fixation portions 41 are locked to the main plate 2, whereby the frame body 4 is fixed to the main plate 2 in a state in which it presses the solar battery 3 (for example, the first protrusion group 31 and the conduction protrusions 34) from above. The conduction protrusions 34 of the solar battery 3 are pressed against the solar battery terminals 25 of the main plate 2 by the frame body 4, whereby reliable electrical conduction is provided between the conduction protrusions 34 and the solar battery terminals 25.

The display plate 5 is, for example, a dial. The display plate 5 is situated within the frame body 4 so as to overlap the solar battery 3. The display panel 5 may be in contact with the solar battery 3 or may be spaced away from the solar battery 3.

The display plate 5 has a main body portion 5A, a plurality of fixation protrusion groups 51, and a pair of displacement regulating protrusions 52. The display plate 5 is formed so as to allow transmission of light necessary for the recharging by the solar battery 3. For example, the display plate 5 is formed of a material allowing transmission of the light mentioned above. It is only necessary for the display plate 5 to allow transmission of the requisite light for recharging. Even in the case where a material allowing no transmission of light is employed, there may be formed therein, for example, a plurality of minute through-holes, through which light can be transmitted.

The main body portion 5A is formed in a substantially circular configuration as seen from a direction parallel to the center axis C. At the center of the main body portion 5A, there is formed an insertion hole 56 through which the indicator hand shaft 6 is passed. A first main surface 5*a* of the main body portion 5A has, for example, a display region (not shown) formed over the entire periphery around the center axis C and indicating time. In this display region, there are formed a plurality of graduations (indicators) (not shown) indicating time. The plurality of graduations are formed, for example, at predetermined positions around the center axis C, indicating time by the indicator hands (not shown).

Each of the fixation protrusion groups 51 has two fixation protrusions 53. The fixation protrusions 53 are formed at the outer peripheral edge 5*c* of the main body portion 5A so as to protrude outwards in the radial direction of the main body portion 5A. The two fixation protrusions 53 are in close proximity to each other, and are formed at an interval in the peripheral direction R.

The recessed portion formed between the two fixation protrusions 53 will be referred to as a fixation recess 54 (fixation receiving portion). The fixation recess 54 is formed at a position where it can be fit-engaged with the fixation protrusion 23 of the main plate 2. The dimension in the peripheral direction R of the fixation recess 54 is designed such that the fixation protrusion 23 of the main plate 2 can be fit-engaged with the fixation recess 54 to fix the display plate 5 in position.

The plurality of fixation protrusion groups 51 are at positions spaced away from each other in the peripheral direction R. The number of the fixation protrusion groups 51 is the same as that of the fixation protrusions 23 of the main plate 2 (four).

Displacement regulating protrusions 52 are formed at the outer peripheral edge 5*c* of the main body portion 5A so as to protrude outwards in the radial direction of the main body portion 5A. Each displacement regulating protrusion 52 is in close proximity to one of the two fixation protrusions 53 constituting each fixation protrusion group 51, and is formed at an interval in the peripheral direction R from this fixation protrusion 53.

The recessed portion formed between the displacement regulating protrusion 52 and the fixation protrusion 53 will be referred to as the second positioning recesses 55. The number of second positioning recesses 55 is the same as the number of the second positioning protrusions 22 of the main plate 2 (two). The second positioning recesses 55 are formed at positions where the second positioning protrusions 22 of the main plate 2 can be locked thereto. The dimension in the peripheral direction R of the second positioning recesses 55 is designed such that when the second positioning protrusions 22 of the main plate 2 enter the second positioning recesses 55 to be locked thereto, it is possible to regulate positional deviation of the display plate 5.

For example, the fixation protrusions 53 and the displacement regulating protrusions 52 abut the height base portions 24 of the main plate 2 to regulate downward movement, whereby the display plate 5 is set in position in the thickness direction. In the electronic timepiece 10 shown in FIG. 1, the two fixation protrusions 53 respectively abut the first height base portion 24*a* and the second height base portion 24*b*, and the displacement regulating protrusion 52 abuts the third height base portion 24*c*. As a result, the display plate 5 is set in position in the thickness direction.

The indicator hand shaft 6 is formed so as to protrude in the first axial direction C1 (upwards in FIG. 1). The indicator hand shaft 6 has, for example, shafts for the hour hand, the minute hand, and the second hand (not shown). The hour hand, the minute hand, and the second hand are respectively fixed to these shafts. The indicator hand shaft 6 is driven, for example, by a motor (not shown) in the movement 1.

Next, a method of assembling the electronic timepiece 10 will be described with reference to FIGS. 2 through 7.

Figure 2:
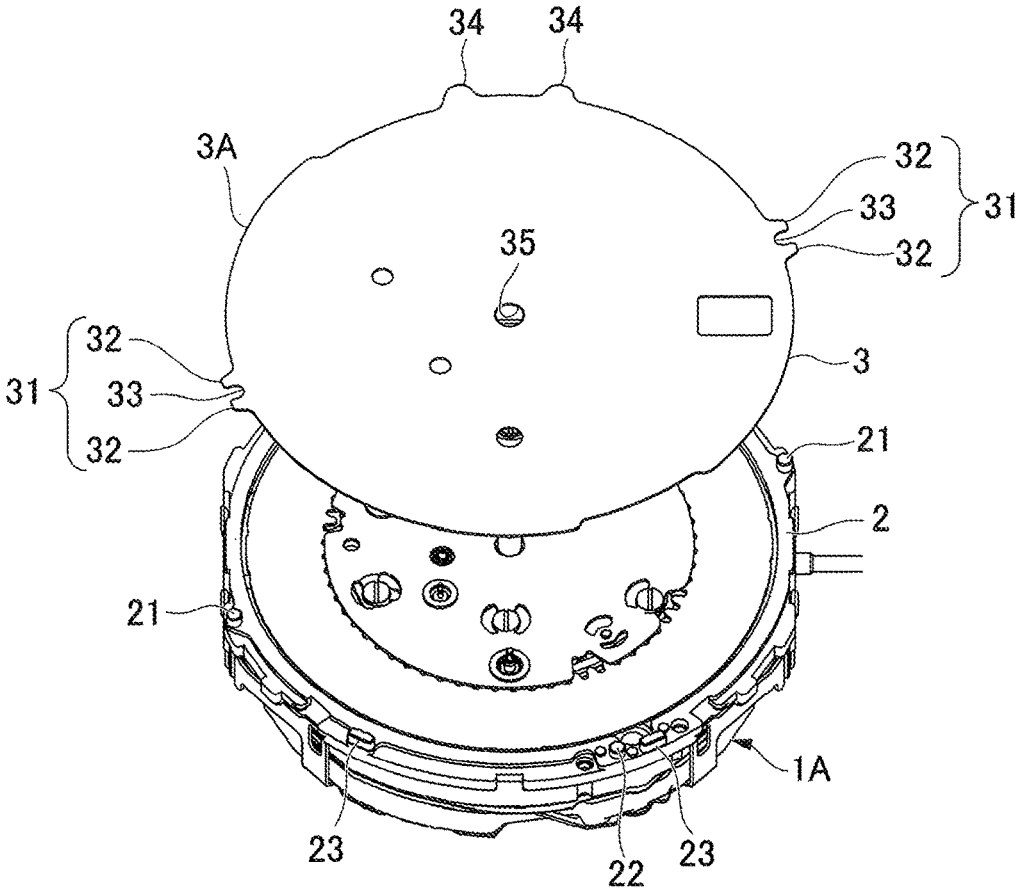
FIG. 2 is a perspective view illustrating the assembly process of the timepiece of FIG. 1.
Figure 3:
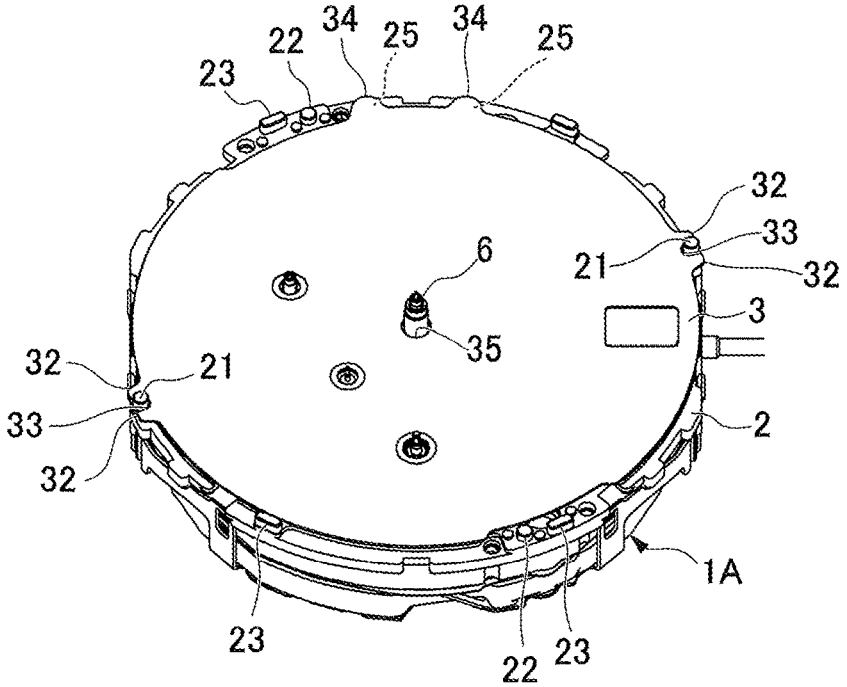
FIG. 3 is a perspective view illustrating how a solar battery is mounted.

As shown in FIGS. 2 and 3, the solar battery 3 is mounted to the main plate 2. The first positioning protrusions 21 of the main plate 2 are locked to the first positioning recesses 33 of the solar battery 3, whereby the solar battery 3 is set in position in the in-plane direction with respect to the main plate 2. The conduction protrusions 34 abut the solar battery terminals 25 of the main plate 2 to provided electrical conduction.

Figure 4:
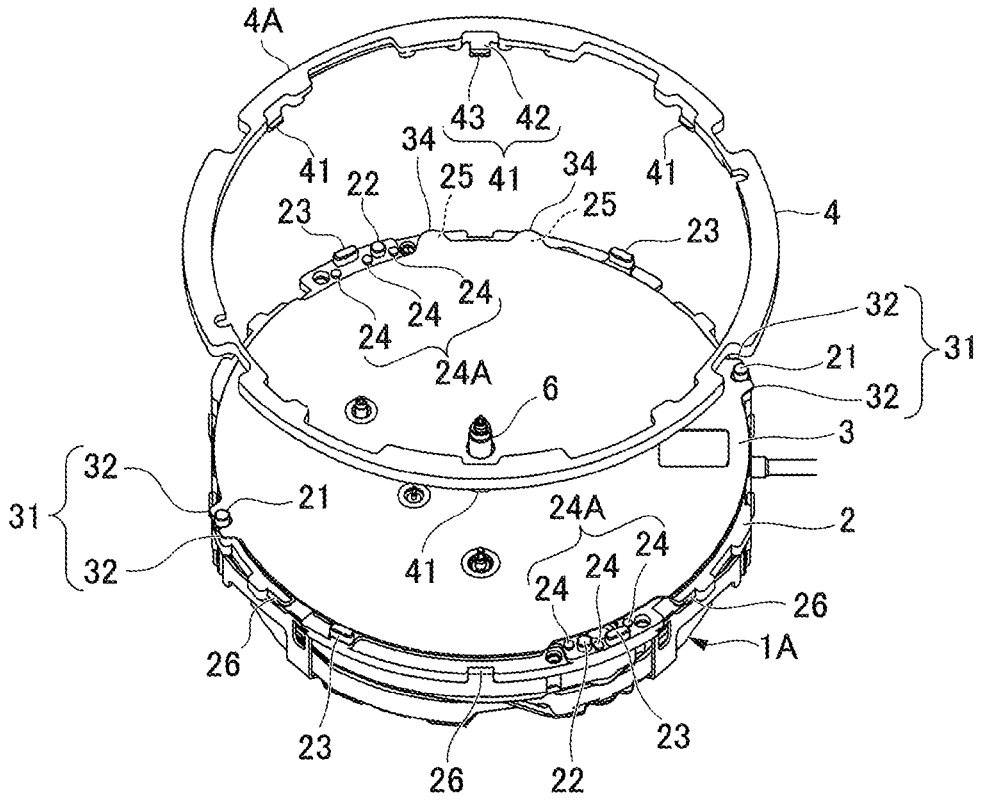
FIG. 4 is a perspective view illustrating the assembly process subsequent to that of the above drawing.
Figure 5:
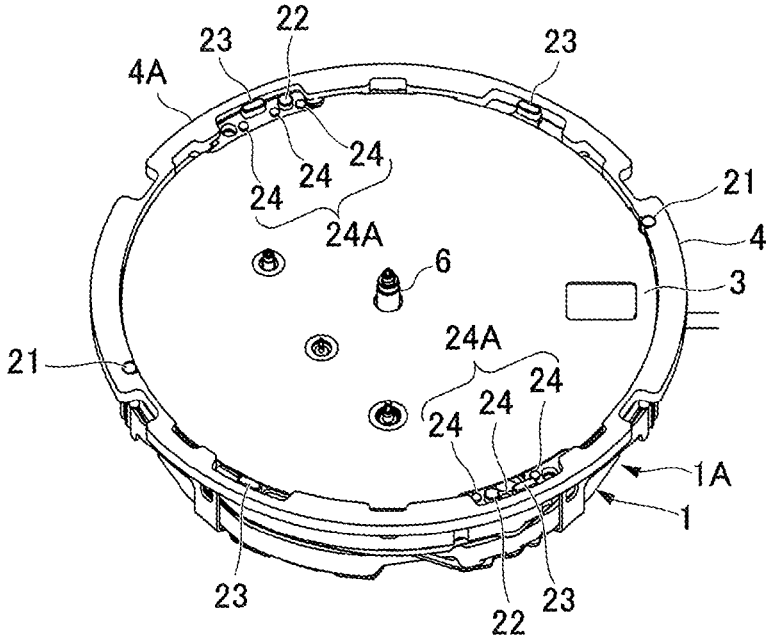
FIG. 5 is a perspective view illustrating how a frame body is mounted.

Next, as shown in FIGS. 4 and 5, the frame body 4 is mounted to the main plate 2. The main portions 42 of the frame body fixation portions 41 enter the engagement recesses 26 of the main plate 2, and the lower ends of the fixation claws 43 are locked to the main plate 2 at the lower ends of the engagement recesses 26, whereby the frame body 4 is fixed to the main plate 2. The frame body 4 is fixed to the main plate 2 while pressing the solar battery 3 (e.g., the first protrusion groups 31 and the conduction protrusions 34) from above. The conduction protrusions 34 are pressed against the solar battery terminals 25 by the frame body 4, whereby there is provided a reliable electrical conduction.

Figure 6:
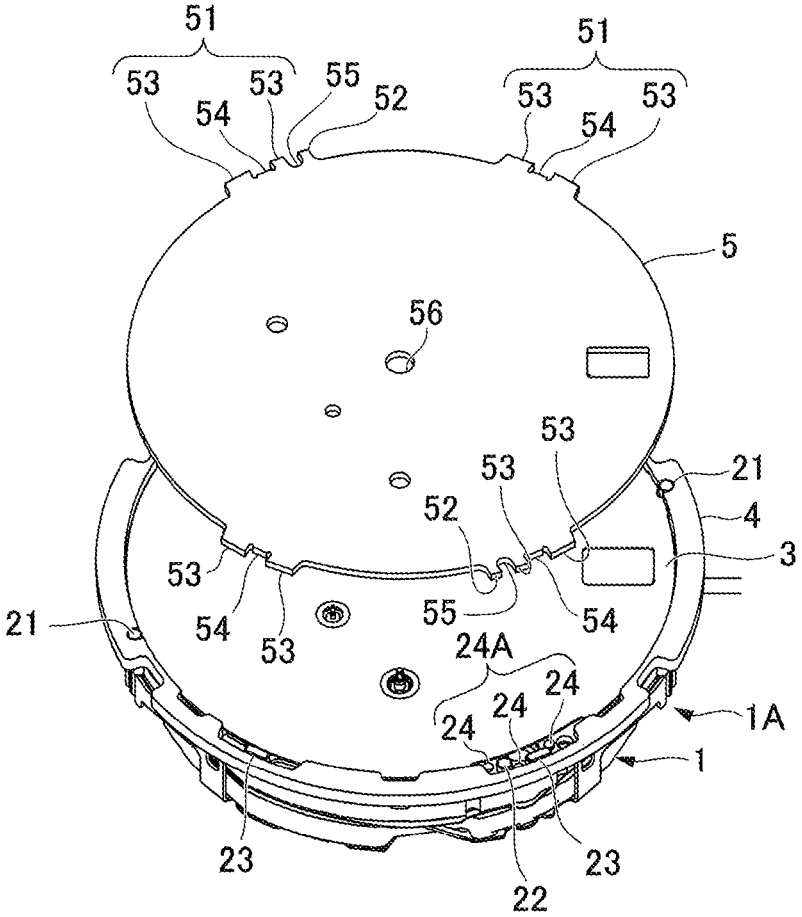
FIG. 6 is a perspective view illustrating the assembly process subsequent to that of the above drawing.
Figure 7:
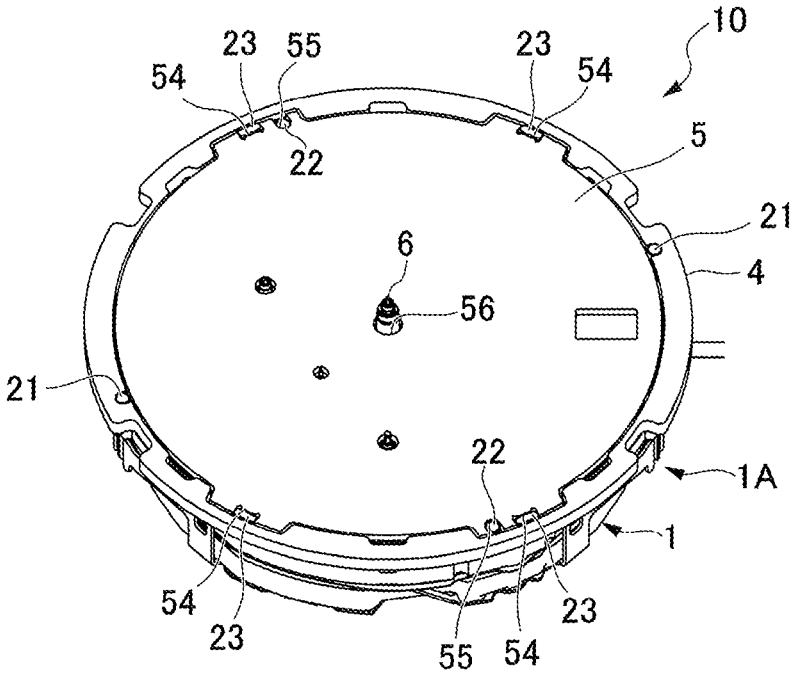
FIG. 7 is a perspective view illustrating how a display plate is mounted.

Next, as shown in FIGS. 6 and 7, the display plate 5 is mounted to the main plate 2. The second positioning protrusions 22 of the main plate 2 are locked to the second positioning recesses 55 of the display plate 5, whereby the display plate 5 is set in position in the in-plane direction with respect to the main plate 2. The fixation protrusions 23 of the main plate 2 are engaged with the fixation recesses 54, whereby the display plate 5 is fixed to the main plate 2.

In this way, the electronic timepiece 10 shown in FIG. 1 is assembled.

In the electronic timepiece 10, both the solar battery 3 and the display plate 5 are set in position with respect to the main plate 2, so that it is possible to set the solar battery 3 and the display plate 5 in position accurately in the in-plane direction. Further, the display plate 5 is set in position while directly in contact with the main plate 2, so that it is possible to set the display plate 5 accurately in position in the thickness direction. Thus, it is possible to design, for example, the gap between the indicator hand and the display plate 5, which is advantageous from the viewpoint of a reduction in the thickness of the electronic timepiece 10.

In the electronic timepiece 10, the first positioning protrusions 21 and the second positioning protrusions 22 are formed on the main plate 2, the first positioning recesses 33 to be engaged with the first positioning protrusions 21 are formed in the solar battery 3, and the second positioning recesses 55 to be engaged with the second positioning protrusions 22 are formed in the display plate 5. Thus, as compared with the case where protrusions are formed on the solar battery and the display plate and where recesses to be locked to the protrusions are formed in the main plate, the structure of the solar battery and of the display plate is simplified, and the production thereof is facilitated.

In the electronic timepiece 10, there is provided the frame body 4, so that it is possible to prevent rising of the solar battery 3, making it possible to set the solar battery 3 in position accurately in the thickness direction. Further, the frame body 4 is formed in a configuration surrounding the outer periphery of the display plate 5, whereby it is possible to prevent the display plate 5 from being inadvertently detached when accommodating the movement 1, etc. in the case. Further, the conduction protrusions 34 of the solar battery 3 are pressed against the solar battery terminals 25 of the main plate 2 by the frame body 4, so that it is possible to provide a reliable electrical conduction between the conduction protrusions 34 and the solar battery terminals 25.

In the electronic timepiece 10, the main plate 2 has the height base portions 24 abutting the display plate 5 and determining the position in the thickness direction of the display plate 5, so that it is possible to enhance the positioning accuracy in the thickness direction of the display plate 5.

In the electronic timepiece 10, the fixation protrusions 23 are formed on the main plate 2, and the fixation recesses 54 to be engaged with the fixation protrusions 23 are formed on the display plate 5, so that it is possible to fix the display plate 5 reliably to the main plate 2.

The electronic timepiece 10 has the solar battery 3, so that it is possible to convert light from the sun, illumination or the like to electrical energy and to utilize it.

Second Embodiment

Next, the second embodiment will be described. In the following, the components common to those of the above embodiment are indicated by the same reference numerals, and a description thereof will be left out.

Figure 8:
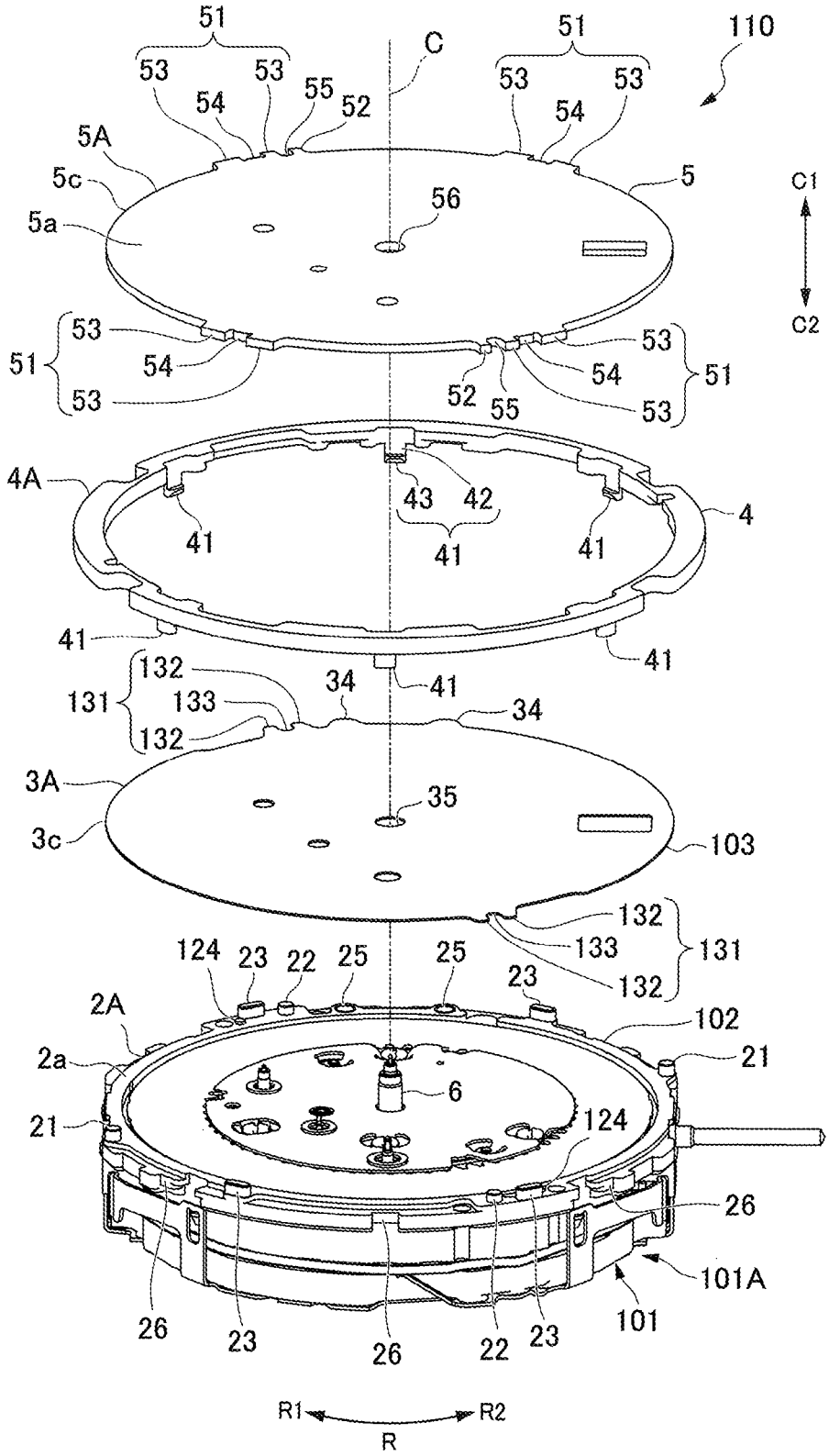
FIG. 8 is an exploded perspective view of a timepiece according to a second embodiment.

FIG. 8 is an exploded perspective view of an electronic timepiece 110 (timepiece) according to the second embodiment.

As shown in FIG. 8, the electronic timepiece 110 is equipped with a movement 101 and the display plate 5. The movement 101 is equipped with a movement main body 101A, a main plate 102, a solar battery 103, the frame body 4, and the indicator hand shaft 6.

In the solar battery 103, the positions in the peripheral direction R of the pair of first protrusion groups 131 differ from those of the solar battery 3 of the electronic timepiece 10 of the first embodiment.

Each of the pair of first protrusion groups 131 has two displacement regulating protrusions 132. The recessed portion formed between the two displacement regulating protrusions 132 will be referred to as a first positioning recess 133 (the first positioning receiving portion). The first positioning recesses 133 are formed at positions where the second positioning protrusions 22 of the main plate 102 can be locked thereto. The dimension in the peripheral direction R of the first positioning recesses 133 is designed such that it is possible to regulate positional deviation of the solar battery 103 when the second positioning protrusions 22 of the main plate 102 enter the first positioning recesses 133 and are locked thereto.

The main plate 102 has a pair of height base portions 124 instead of the pair of height base portion groups 24A of the electronic timepiece 10 of the first embodiment. The height base portions 124 are formed on the first main surface 2*a* of the main body portion 2A so as to protrude in the first axial direction C1 (upwards in FIG. 1). The height base portions 124 are situated so as to be in close proximity to the fixation protrusions 23.

For example, the fixation protrusions 53 and the displacement regulating protrusions 52 abut the height base portions 124 of the main plate 2 to regulate downward movement, whereby the display plate 5 is set in position in the thickness direction.

In the electronic timepiece 110, both the solar battery 103 and the display plate 5 are set in position with respect to the main plate 102, so that it is possible to set the solar battery 103 and the display plate 5 in position accurately in the in-plane direction. Further, the display plate 5 can be accurately set in position in the thickness direction, so that it is possible to design, for example, the gap between the indicator hand and the display plate 5 small, which is advantageous from the viewpoint of a reduction in the thickness of the electronic timepiece 110.

In the electronic timepiece 110, the solar battery 103 and the display plate 5 are set in position with respect to the common second positioning protrusion 22, so that, as compared with the case where the positioning protrusions to which the solar battery and the display plate are locked are different from each other, it is possible to enhance the positioning accuracy of the solar battery 103 and the display plate 5.

Third Embodiment

Next, the third embodiment will be described. In the following, the components that are common to those of the above embodiments are indicated by the same reference numerals, and a description thereof will be left out.

Figure 9:
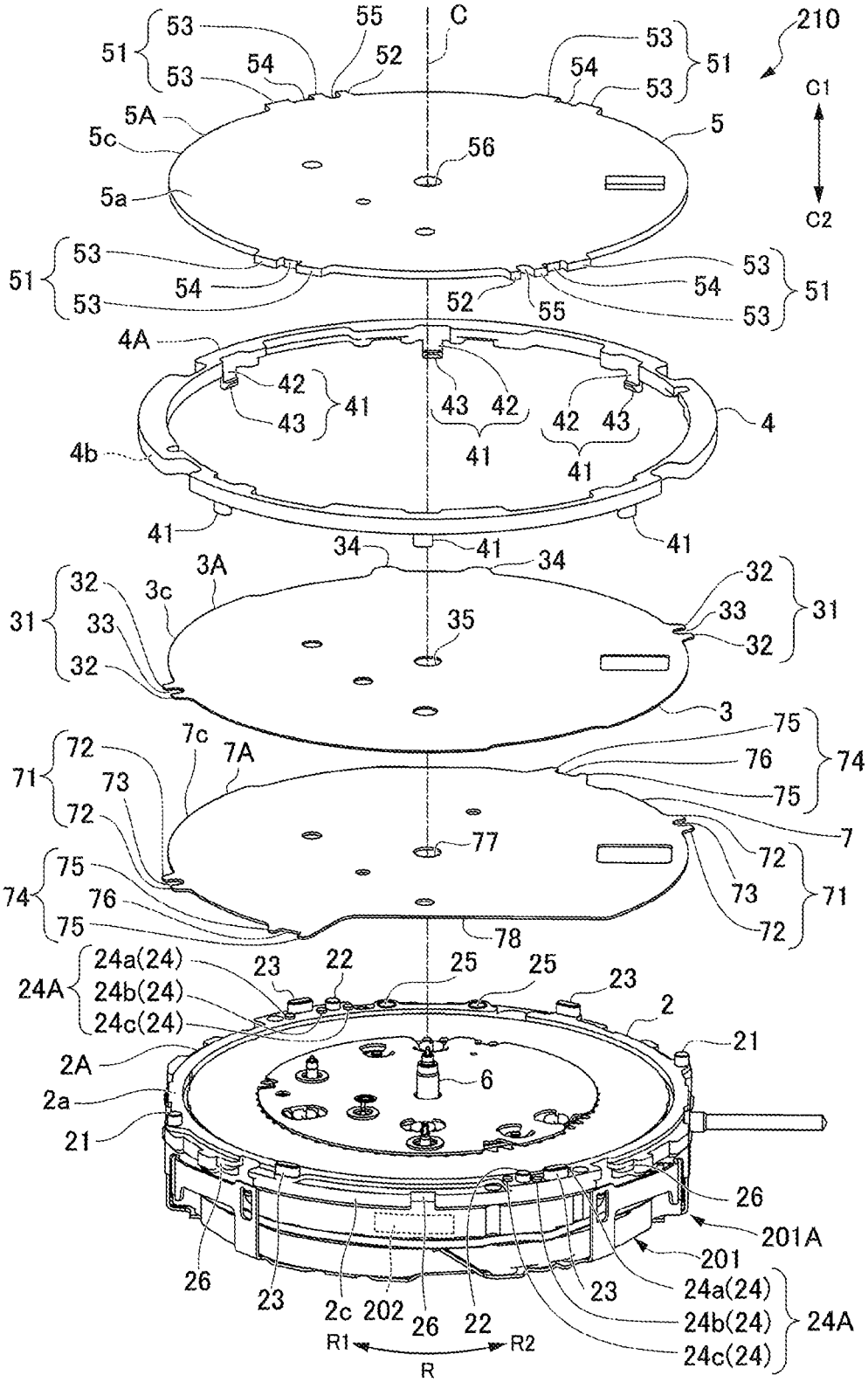
FIG. 9 is an exploded perspective view of a timepiece according to a third embodiment.

FIG. 9 is an exploded perspective view of an electronic timepiece 210 according to the third embodiment.

As shown in FIG. 9, the electronic timepiece 210 is equipped with a movement 201 and the display plate 5. The movement 201 is equipped with a movement main body 201A, the main plate 2, an anti-magnetic plate 7, the solar battery 3, the frame body 4, and the indicator hand shaft 6. The movement main body 201A contains an antenna element 202.

The anti-magnetic plate 7 has a function by which it suppresses the influence of an external magnetic field on the movement main body 201A (for example, a motor). The anti-magnetic plate 7 is formed, for example, of a metal (conductive material) such as permalloy, pure iron, or stainless steel. It is desirable for the anti-magnetic plate 7 to be formed of a magnetic material (in particular, a high magnetic permeability material). The anti-magnetic plate 7 is provided on the lower surface side (the main plate 2 side) of the solar battery 3.

The anti-magnetic plate 7 has a main body portion 7A, a pair of first protrusion groups 71, and a pair of guide protrusion groups 74. The main body portion 7A is formed in a substantially circular configuration as seen from a direction parallel to the center axis C. At the center of the main body portion 7A, there is formed an insertion hole 77 through which the indicator hand shaft 6 is passed.

The main body portion 7A has a cutout 78. The cutout 78 is formed at a part of the peripheral edge of the main body portion 7A. The cutout 78 is formed such that the anti-magnetic plate 7 avoids a position where it overlaps the antenna element 202 as seen in a direction parallel to the center axis C (that is, as seen from the thickness direction of the main plate 2). Due to the cutout 78, it is possible to prevent the antenna element 202 from being covered with the anti-magnetic plate 7. Thus, it is possible to enhance the transmission/reception characteristics of the antenna element 202.

Each of the pair of first protrusion groups 71 has two displacement regulating protrusions 72. The displacement regulating protrusions 72 are formed at an outer peripheral edge 7*c* of the main body portion 7A so as to protrude outwards in the radial direction of the main body portion 7A. The two displacement regulating protrusions 72 are in close proximity to each other, and are formed at an interval in the peripheral direction R.

The recessed portion formed between the two displacement regulating protrusions 72 will be referred to as a third positioning recess 73 (the third positioning receiving portion). The third positioning recess 73 is formed at a position where the first positioning protrusion 21 of the main plate 2 can be locked. The dimension in the peripheral direction R of the third positioning recess 73 is designed such that when the first positioning protrusion 21 of the main plate 2 enters the third positioning recess 73 and is locked thereto, it is possible to regulate positional deviation of the anti-magnetic plate 7.

The pair of first protrusion groups 71 are at positions spaced apart from each other in the peripheral direction R. There are no particular restrictions regarding the relative positions of the pair of first protrusion groups 71. For example, it is desirable for them to be positions of rotational symmetry with respect to the center axis C.

The number of first protrusion groups is not restricted to 2. It may be 1, or an arbitrary number of 2 or more (plural number). The plurality of first protrusion groups can be formed at rotationally symmetrical positions of n-times symmetry (n is an integer of 2 or more) with respect to the center axis C.

Each of the guide protrusion groups 74 has two guide protrusions 75. The guide protrusions 75 are formed at the outer peripheral edge 7*c* of the main body portion 7A so as to protrude outwards in the radial direction of the main body portion 7A. The two guide protrusions 75 are in close proximity to each other, and are formed at an interval in the peripheral direction R.

The recessed portion formed between the two guide protrusions 75 will be referred to as a guide recess 76 (guide receiving portion). The guide recess 76 is formed at a position where the fixation protrusion 23 of the main plate 2 enters. The dimension in the peripheral direction R of the guide recess 76 is designed such that the fixation protrusion 23 of the main plate 2 can enter the guide recess 76 and be locked thereto. In the electronic timepiece 210, even when the third positioning recess 73 undergoes deformation through the application of a shock due to dropping or the like, the fixation protrusion 23 is locked to the guide recess 76, whereby it is possible to prevent detachment of the anti-magnetic plate 7.

The pair of guide protrusion groups 74 are at positions spaced away from each other in the peripheral direction R. There are no particular restrictions regarding the relative positions of the pair of guide protrusion groups 74. For example, it is desirable for them to be at rotationally symmetrical positions with respect to the center axis C.

The number of guide protrusion groups is not restricted to 2. It may be 1 or an arbitrary number (plural number) of 2 or more. The plurality of guide protrusion groups can be formed at rotationally symmetrical positions of n-times symmetry (n is an integer of 2 or more) with respect to the center axis C.

The anti-magnetic plate 7 is electrically continuous with a ground conduction portion (conduction portion) provided on the movement main body 201A. As a result, it is possible to suppress electrostatic noise. The anti-magnetic plate 7 and the ground conduction portion may be contact with each other directly or through the intermediation of a conduction member.

Figure 10:
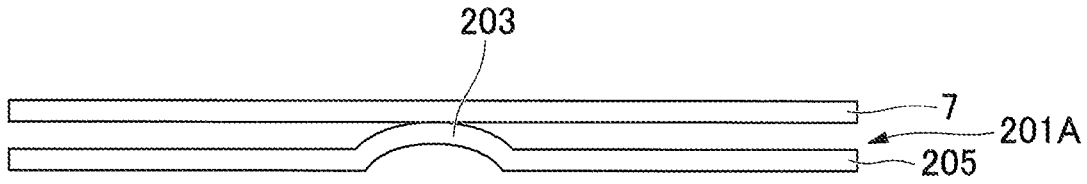
FIG. 10 is a schematic diagram illustrating an example of an abutment structure of an anti-magnetic plate and a ground conduction portion.
Figure 11:
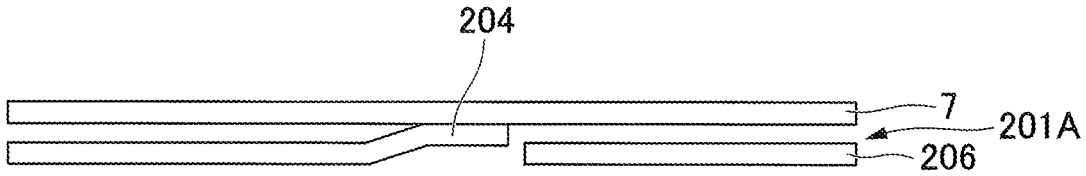
FIG. 11 is a schematic diagram illustrating another example of an abutment structure of an anti-magnetic plate and a ground conduction portion.

FIGS. 10 and 11 show an example of the structure in which the anti-magnetic plate 7 and the ground conduction portion are directly in contact with each other. In the structure shown in FIG. 10, the ground conduction portion 203 is a protrusion formed on a metal plate 205 of the movement main body 201A, and abuts the lower surface of the anti-magnetic plate 7. The ground conduction portion 203 is of a configuration the upper surface of which is convex and the lower surface of which is concave (for example, a half blanking configuration). In the structure shown in FIG. 11, a ground conduction portion 204 is an elastic member extending from a metal plate 206 of the movement main body 201A, and abuts the lower surface of the anti-magnetic plate 7. In the structures shown in FIGS. 10 and 11, the ground conduction portions 203 and 204 are respectively formed integrally with the metal plates 205 and 206. Due to their elastic force, the ground conduction portions 203 and 204 can secure the abutment of the elastic plate 7.

While in FIGS. 10 and 11 the ground conduction portion has the above-mentioned abutment structure (the protrusion or the elastic member), this abutment structure may be provided on the anti-magnetic plate 7. That is, it is possible, for example, to adopt a structure in which a protrusion of a half blanking configuration provided on the anti-magnetic plate 7 abuts the metal plate of the movement main body 201A. Further, it is also possible to adopt a structure in which the elastic member provided on the anti-magnetic plate 7 abuts the metal plate of the movement main body 201A. Further, the above-mentioned abutment structure (the protrusion or the elastic member) may be provided on both the anti-magnetic plate 7 and the movement main body 201A.

In the case where there is adopted a structure in which a conduction member is provided between the anti-magnetic plate 7 and the ground conduction portion, it is possible to use a dial washer, a washer, a plate spring or the like as the conduction member.

Next, a method of assembling the electronic timepiece 210 will be described with reference to FIGS. 12 and 13.

Figure 12:
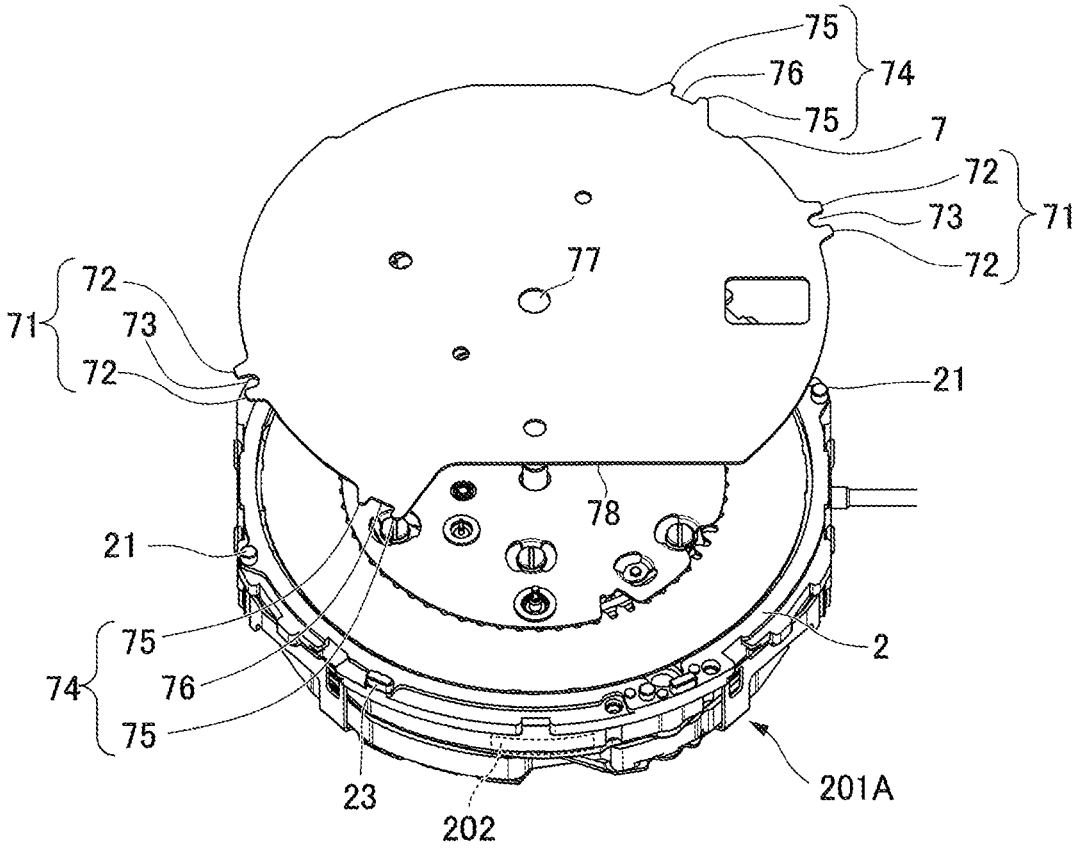
FIG. 12 is a perspective view illustrating the assembly process of the timepiece of FIG. 9.
Figure 1:
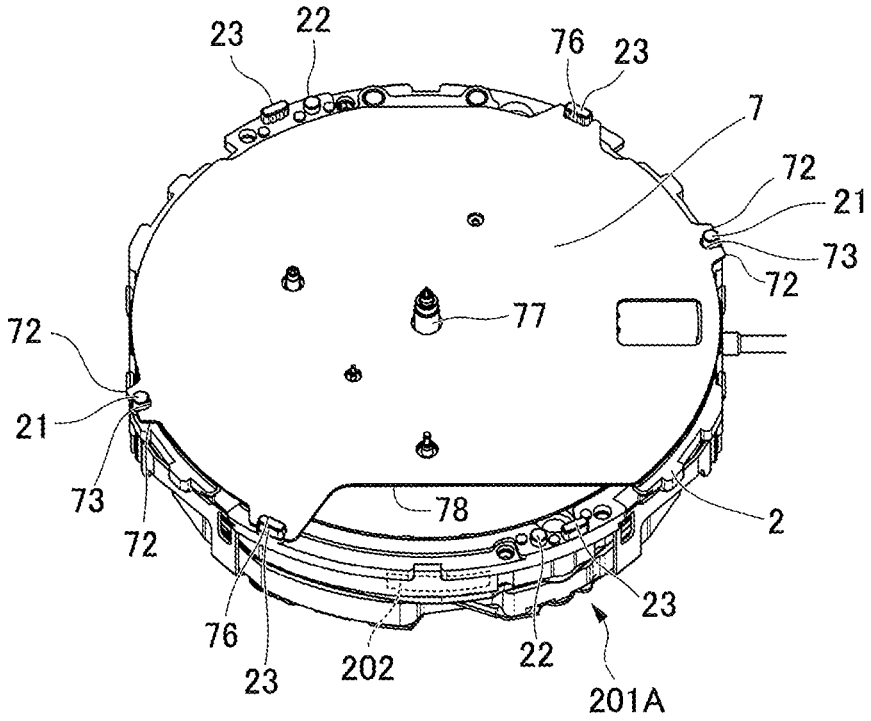

As shown in FIGS. 12 and 13, the anti-magnetic plate 7 is mounted to the main plate 2. The first positioning protrusions 21 of the main plate 2 are locked to the third positioning recesses 73. The fixation protrusions 23 of the main plate 2 are locked to the guide recesses 76. Next, as in the case of the assembly method of the first embodiment, the solar battery 3, the frame body 4, and the display plate 5 are installed (See FIGS. 2 through 7). In this way, the electronic timepiece 210 shown in FIG. 9 is assembled.

In the electronic timepiece 210, all of the anti-magnetic plate 7, the solar battery 3, and the display plate 5 are set in position with respect to the main plate 2, so that the anti-magnetic plate 7, the solar battery 3, and the display plate 5 can be accurately set in position in the in-plane direction.

The technical scope of the present invention is not restricted to those of the above-described embodiments but allows various modifications without departing from the scope of the gist of the present invention.

While in the electronic timepiece 10 shown in FIG. 1 the protrusions 21 and 22 are formed on the main plate 2, and the positioning recesses 33 and 55 are respectively formed in the solar battery 3 and the display plate 5, the timepiece of the embodiment is not restricted to this construction. For example, the positioning protrusions may be respectively formed on the solar battery and the display plate, and the positioning recesses to be engaged with the positioning protrusions may be formed in the main plate. In this case, the positioning protrusions formed on the solar battery and the display panels are respectively "the first positioning receiving portion" and "the second positioning receiving portion," and the positioning recesses of the main plate are the "positioning portions."

While in the electronic timepiece 10 shown in FIG. 1 the fixation recesses 54 of the display plate 5 are engaged with the fixation protrusions 23 of the main plate 2, the timepiece of the embodiment is not restricted to this construction. It is also possible to adopt a structure in which the protrusions (fixation receiving portions) of the display plate are engaged with the recesses (display plate fixation portions) of the main plate.

While in the electronic timepiece 10 shown in FIG. 1 the display plate 5 is arranged on the solar battery 3, in the timepiece of the embodiment, the solar battery may be arranged on the display plate.

While the electronic timepiece 10 shown in FIG. 1 has the frame body 4 for retaining the solar battery 3, the timepiece of the embodiment may adopt a construction having no frame body.

While the electronic timepiece 10 shown in FIG. 1 has the solar battery 3, the timepiece of the embodiment may employ, instead of the solar battery 3, some other plate member such as an antenna consisting of a plate-like coil or a plate-like organic EL (ElectroLuminescence) display device.

In the electronic timepiece 10 shown in FIG. 1, the pair of first positioning recesses 33 are locked to the first positioning protrusions 21, whereby the solar battery 3 is set in position with respect to the main plate 2. The pair of second positioning recesses 55 are locked to the second positioning protrusions 22, whereby the display plate 5 is set in position with respect to the main plate 2.

The timepiece of the embodiment is not restricted to this construction. It is also possible to adopt a construction in which at least one (one) of the plurality of first positioning recesses is locked to one of the positioning protrusions and in which at least one (one) of the plurality of second positioning recesses is locked to one of the positioning protrusions. For example, it is also possible to adopt a construction in which solely a part of the plurality of first positioning recesses are locked to the first positioning protrusions and in which solely a part of the plurality of second positioning recesses are locked to the second positioning protrusions.

In the electronic timepiece 110 shown in FIG. 8, the pair of first positioning recesses 133 are locked to the second positioning protrusions 22, whereby the solar battery 103 is set in position with respect to the main plate 2. The pair of second positioning recesses 55 are locked to the second positioning protrusions 22, whereby the display plate 5 is set in position with respect to the main plate 2.

The timepiece of the embodiment is not restricted to this construction. It is also possible to adopt a construction in which at least one (one) of the plurality of first positioning recesses of the solar battery and at least one (one) of the plurality of second positioning recesses of the display plate are locked to a common positioning recess. For example, it is also possible to adopt a construction in which a part of the plurality of first positioning recesses and a part of the plurality of second positioning recesses are locked to a common second positioning protrusion.

What is claimed is:

1. A timepiece comprising:

a movement case housing a movement inside and having a main plate on an upper surface side of the movement case, the main plate having first and second sets of stoppers standing vertically directly from the main plate;

a plate member placed directly on the main plate of the movement case, the plate member having one or more first positioning receptors configured to engage directly with either the first or second set of stoppers of the main plate to immobilize the plate member directly on the main plate;

an annular frame comprising a retainer configured to engage with a side surface of the movement case to retain the annular frame on the main plate in such a manner that the annular frame presses the plate member against the main plate between the annular frame and the main plate; and a display plate placed within the annular frame directly on the plate member; the display plate having one or more second positioning receptors configured to engage directly with either the first or second set of stoppers of the main plate to immobilize the display plate directly on the main plate.

2. The timepiece according to claim 1, wherein the first and second stoppers are protrusions formed directly on the main plate; and the first and second positioning receptors are recesses configured to engage directly with the first and second stoppers, respectively.

3. The timepiece according to claim 1, wherein the main plate has a set of spacers standing vertically directly from the main plate, the set of spacers being in contact with the display plate to define a space between the display plate and the main plate.

4. The timepiece according to claim 2, wherein the main plate has a set of spacers standing vertically directly from the main plate, the set of spacers being in contact with the display plate to define a space between the display plate and the main plate.

5. The timepiece according to claim 1, wherein the main plate has a third set of stoppers vertically standing directly from the main plate, and the display plate has one or more third positioning receptors configured to engage directly with the third set of stoppers to further immobilize the display plate on the main plate.

6. The timepiece according to claim 1, wherein the plate member comprises a solar battery.

7. The timepiece according to claim 1, wherein at least one of the one or more first positioning receptors of the plate member comprises a plurality of first receiving portions, and at least one of the one or more second positioning receptors of the display plate comprises a plurality of second receiving portions, wherein at least one of the first receiving portions is engaged with one of the first or second set of stoppers, and at least one of the second receiving portions is engaged with said one of the first or second set of stoppers.

8. The timepiece according to claim 1, further comprising an anti-magnetic plate provided between the main plate and the plate member; and the anti-magnetic plate has one or more fourth positioning receptors configured to be engaged with either the first or second set of stoppers.

9. The timepiece according to claim 8, further comprising an antenna element provided in the movement case, wherein the anti-magnetic plate has a cutout portion for avoiding the anti-magnetic plate from overlapping the antenna element as seen in a vertical direction.

10. The timepiece according to claim 8, wherein the anti-magnetic plate is electrically connected to a ground conduction portion provided on the main plate side.

11. The timepiece according to claim 8, wherein the anti-magnetic plate has a guide receiving portion configured to be engaged with either the first or second set of stoppers with which the one or more second positioning receptors of the display plate are engaged.

12. A timepiece comprising:

a main plate having one or more positioning portions;

a plate member having one or more first positioning receiving portions to be locked to the positioning portions and arranged so as to overlap the main plate; and a display plate having one or more second positioning receiving portions to be locked to the positioning portions and arranged so as to overlap the plate member, wherein an anti-magnetic plate is provided on the main plate side of the plate member; and the anti-magnetic plate has one or more third positioning receiving portions to be locked to the positioning portions, and the anti-magnetic plate is electrically continuous with a ground conduction portion provided on the main plate side.

* * * * *